United States Patent [19]

Crump

[11] Patent Number: 4,899,894

[45] Date of Patent: Feb. 13, 1990

[54] MAGNETIC GOLF CLUB HOLDING APPARATUS

[76] Inventor: Gregory A. Crump, 4100 - 65th St., Urbandale, Iowa 50322

[21] Appl. No.: 351,478

[22] Filed: May 15, 1989

[51] Int. Cl.[4] ..... A47F 7/00

[52] U.S. Cl. ..... 211/70.2; 211/DIG. 1; 211/87; 248/309.4

[58] Field of Search ..... 211/DIG. 1, 70.2, 70.6, 211/87, 70.7; 248/37.3, 309.4

[56] References Cited

U.S. PATENT DOCUMENTS

| | | | |
|---|---|---|---|
| 2,510,634 | 6/1950 | Hull . | |
| 2,510,648 | 6/1950 | Moholy-Nagy . | |
| 2,693,788 | 11/1954 | Spatz . | |
| 3,043,437 | 7/1962 | Lockie | 211/70.2 |
| 3,058,504 | 10/1962 | Powers | 211/DIG. 1 X |
| 3,214,169 | 10/1965 | Rupnow . | |
| 3,229,820 | 1/1966 | Hentzi et al. | 248/309.4 X |
| 3,315,815 | 4/1967 | Wittek | 211/70.2 |
| 3,539,185 | 11/1970 | Andis . | |
| 3,827,021 | 7/1974 | Phelon | 248/309.4 X |
| 3,842,980 | 10/1974 | Kushner | 211/DIG. 1 X |
| 3,953,033 | 4/1976 | Kelly et al. . | |
| 4,544,067 | 10/1985 | Miller | 211/DIG. 1 X |
| 4,643,604 | 2/1987 | Enrico . | |

OTHER PUBLICATIONS

Advertising brochure from "The Magnet Store", 607 S. Gilbert, Castle Rock, Colo. 80104–1 page, both sides.

Catalog from Leichtung Workshops, Winter, 1989, 2 pages.

*Primary Examiner*—Robert W. Gibson, Jr.

*Attorney, Agent, or Firm*—Henderson & Sturm

[57] ABSTRACT

A magnetic golf club holding apparatus including a magnetic device which will hold golf clubs in an address position by magnetic forces acting on the club head of such golf clubs. Additionally, golf clubs may be displayed, with a golf club head up or down, by a magnetic structure which holds an intermediate portion of the metal golf club shaft. Telescoping handles on the golf clubs being displayed, in conjunction with indicia on the golf club shaft, allows a golfer to be properly fitted for a proper size and type of grip, and a proper length while the golf club is being held in a proper address position. Also, the golf club holding magnetic devices are versatile enough to be utilized by attachment to a wall or to a slat wall.

8 Claims, 6 Drawing Sheets

MAGNETIC GOLF CLUB HOLDING APPARATUS

This is a division of co-pending application Ser. No. 07/183,081 filed on Apr. 19, 1988.

TECHNICAL FIELD

The present invention relates generally to a golf club holding apparatus and more particularly to such an apparatus which magnetically holds and displays golf clubs in particular ways for merchandising purposes.

BACKGROUND ART

In places where golf clubs are on display for sales purposes such clubs are typically in some kind of a rack leaning against portions of the rack. Golf clubs can also be leaning against a wall or disposed in a golf bag or other containers such as boxes. One problem with the way that golf clubs are normally displayed for sales purposes is that they are typically somewhat in disarray and not particularly inviting to a potential customer.

In Pro Shops, a golf pro is typically interested in trying to help a potential customer chose the proper length, lie angles, grip size, type of grip and the shaft characteristics, such as the flexibleness or kick point of the shaft.

It obviously is extremely important that the golf clubs fit the user in order to provide optimum performance. In the process of advising a potential customer and fitting the customer with golf clubs, it is important to have as many merchandising and sales tools available as possible and the industry has made very little progress in this respect over the years.

DISCLOSURE OF THE INVENTION

The present invention relates to a magnetic golf club holding apparatus including a magnetic device which will hold golf clubs in an address position by magnetic forces acting on the club head of such golf clubs. Additionally, golf clubs may be displayed, with a golf club head up, by a magnetic structure which holds an intermediate portion of the metal golf club shaft. Telescoping handles on the golf clubs being displayed, in conjunction with indicia on the golf club shaft allows a golfer to be properly fitted for a proper size and type of grip, and a proper length while the golf club is being held in a proper address position. Also, the golf club holding magnetic devices are versatile enough to be utilized by attachment to a wall or to a slat wall.

An object of the present invention is to provide an improved apparatus for displaying, holding and merchandising golf clubs.

Another object of the present invention is to provide an apparatus for holding a golf club in an address position while at the same time permitting the golf club to be easily removed from the display device and repositioned after examination thereof.

Another object of the present invention is to provide an apparatus for easily fitting a golfer with a proper club length, lie angle and grip size.

Other objects, advantages, and novel features of the present invention will become apparent from the following detailed description of the invention when considered in conjunction with the accompanying drawings.

BEST MODE FOR CARRYING OUT THE INVENTION

Figure 1:
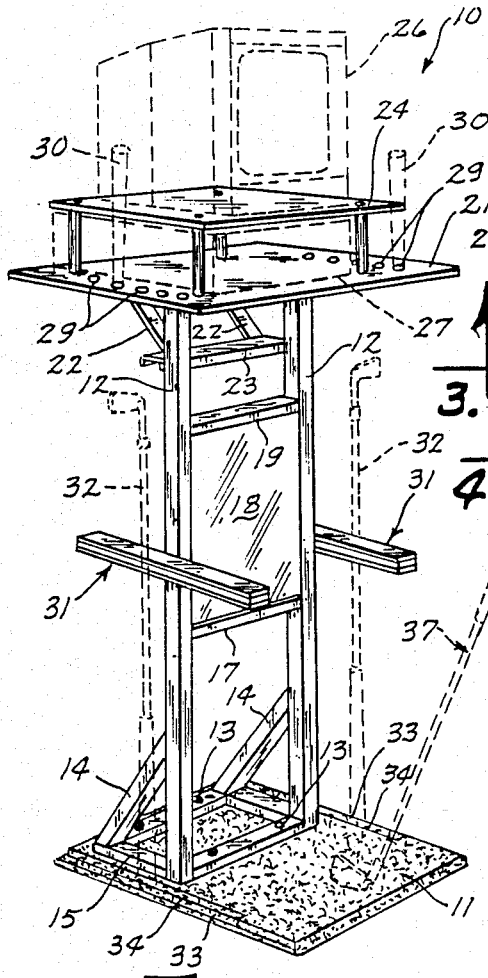
FIG. 1 is a perspective view of a custom golf fit station including magnetic device for holding golf clubs in an address position as shown in dashed lines and furthermore showing in dashed lines how golf clubs can be held with the head extending upwardly on the same station and furthermore showing how a television and VCR can be utilized in conjunction with the custom golf fitting station.
Figure 2:
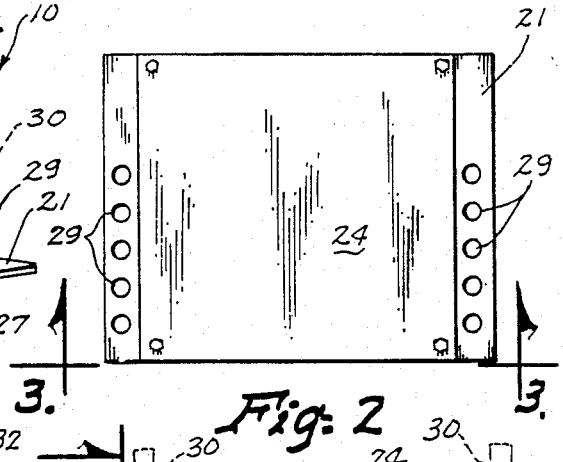
FIG. 2 is a top plan view of the apparatus shown in FIG. 1.
Figure 3:
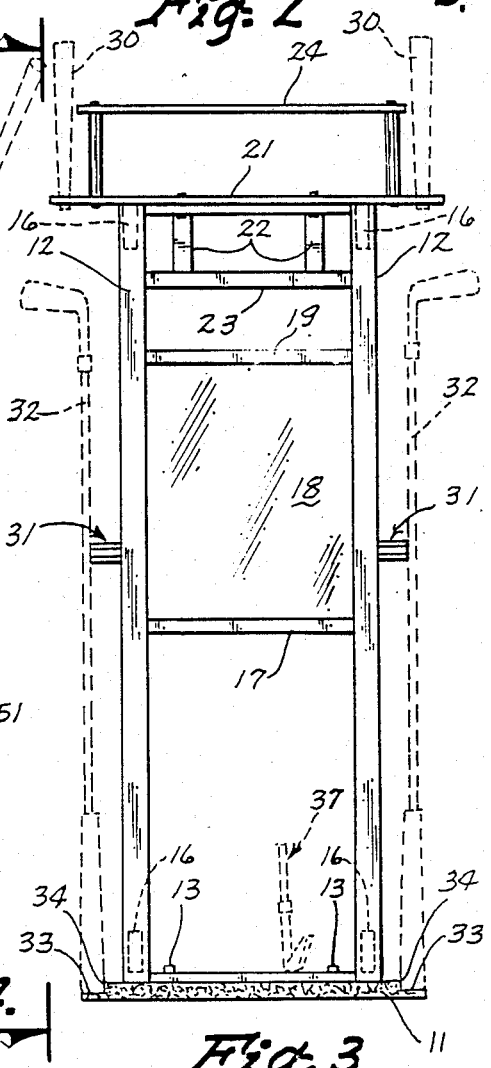
FIG. 3 is a front view taken along line 3—3 of FIG. 2 and showing golf clubs in dashed lines and also showing various handles or grips of golf clubs in dashed lines.

Referring now to the drawings wherein like reference numerals designate identical or corresponding parts throughout the several views, FIG. 1 shows a golf club custom fitting apparatus (10) constructed in accordance with the present invention. The apparatus (10) includes a base (11) having an upright frame (12) bolted to the base (11) by threaded fasteners (13). The frame (13) includes braces (14) and subframe (15), which subframe (15) is also bolted to the base (11) by threaded fasteners (13).

A cross-member (17) is attached to the two upright posts (12) and a pair of plexiglass sheets (18) slide down into the flange (17) and are held at the bottom thereof in such flange (17). These plexiglass sheets (18) are clear and transparent so that display or advertising materials can be placed between them and such materials can be easily changed by removing a top flange (19) and sliding such advertising or display materials between the plexiglass sheets (18). Furthermore, the sheets (18) are removable in case the user desires to place the display materials between the plexiglass members (18) before reinserting them between the flange members (17) and (19).

A metal plate (21) is bolted to the top of the frame members (12) and braces (22) and (23) are utilized to provide structural integrity to the plate (21) to keep it in a horizontal position while the frame members (12) are disposed in a vertical position. A top plate (24) is bolted, through spacers (25), to the plate (21). A television (26) shown in dashed lines in FIG. 1 can be placed on the plate (24) and a VCR (27), shown in dashed lines in FIG. 1, can be disposed between the plates (21) and (24) for playing merchandising video tapes on the television (26) which will attract the attention of customers.

A plurality of openings (29) are disposed in each side of the plate (21) for receiving grips or handles (30) for reasons which will become apparent below. Magnetic bar assemblies (31) are magnetically attached to the upright frame member (12) for holding the metal shaft of golf clubs (32), shown in dashed lines in FIG. 1. These golf clubs (32) fit into a depression (33) having an upright vertical wall (34) associated therewith.

Figure 26:
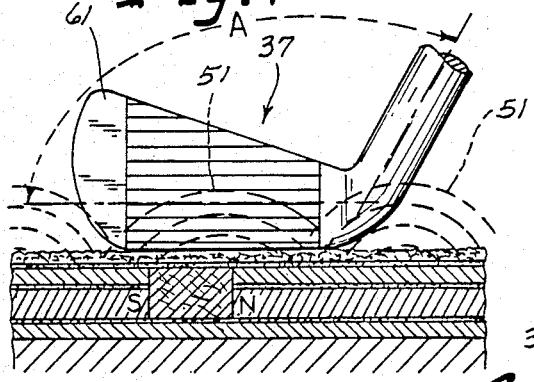
FIG. 26 is a cross sectional view like FIG. 7 and showing a golf club head and how the magnetic forces of bar magnets pass through the golf club head to hold the golf club head in an address position on the platform of the apparatus of FIG. 1 and also simulating how it would hold the golf club in the FIG. 16 embodiment as well.

A magnetic assembly (35) is disposed underneath a felt cover (36) for the platform (11) for holding a golf club (37) in an address position as shown in dashed lines in FIG. 1 and as shown in solid lines in FIG. 26.

Figure 6:
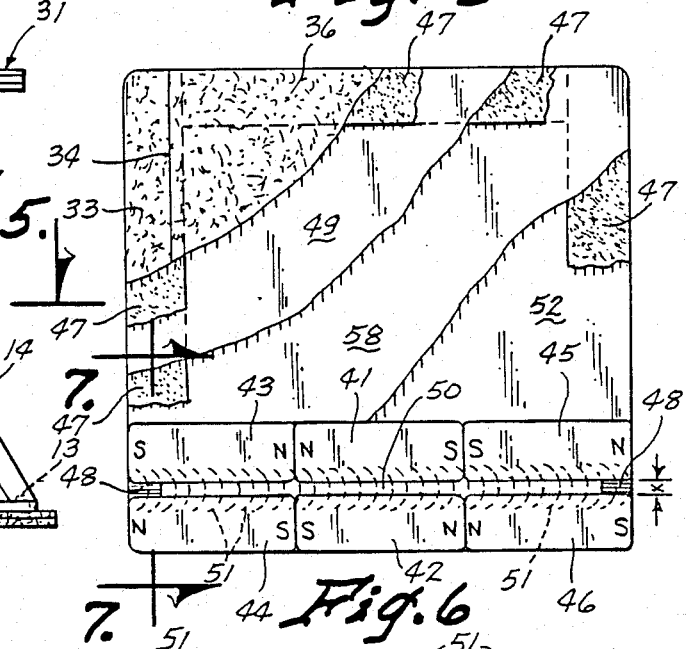
FIG. 6 is a view of the platform portion of the apparatus shown in FIG. 1 and showing layers stripped away layer by layer to show the magnetic structure and in a related structure associated therewith.
Figure 7:
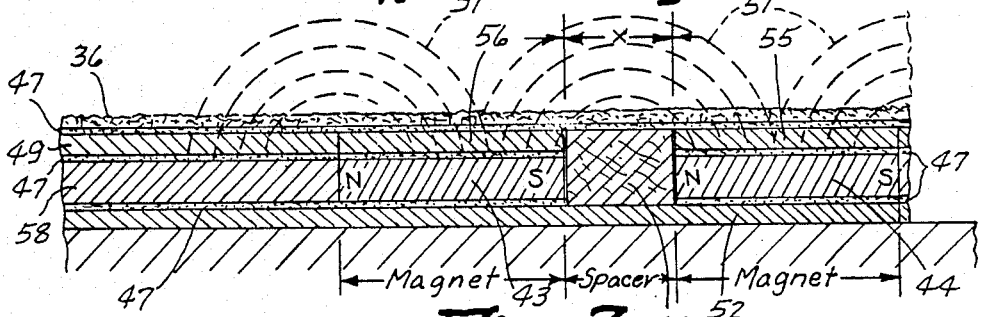
FIG. 7 is a cross sectional view taken along line 7—7 of FIG. 6.

Referring to FIGS. 6 and 7, it is noted that a plurality of ceramic bar magnets (41), (42), (43), (44), (45) and (46) are all of an identical configuration. These magnets are two inches by six inches by one-fourth inch in size. It is important that the polarity of the magnets be as shown in FIG. 6 wherein the north pole of magnet (41) is against the north pole of magnet (43) and the south pole of magnet (41) is against the south pole of magnet (45). These magnets (41)-(46) preferably have double faced tape (47) thereon, although that is optional, between the layers as shown in FIG. 7. Double faced tape will help to keep the parts in their proper relative positions. Additionally, wooden spacers (48) are disposed between the magnets, as is shown in FIGS. 6 and 7, so as to maintain an optimum distance "x" as shown in FIGS. 6 and 7. This optimum distance "x" is one-half inch plus or minus one-quarter of an inch for normal golf club heads, although it has been determined that the invention will operate when "x" is in a range of approximately one-quarter of an inch to one and one-half inches.

The magnets (42), (44) and (46) are arranged so that the south poles across the gap (50) are directly across from the opposite pole on the respective magnets (41), (43) and (45). This arrangement produces the lines of magnetic flux (51) shown in FIGS. 6 and 7 and also shows how these lines of flux (51) pass through a golf club head (37), as shown in FIG. 26 to hold the club head (37) in the positions shown in FIGS. 1 and 26.

It will be understood, of course, that any number of magnets can be utilized in this invention, from one on up to as many as are required, but it is important that like poles of abutting magnets be adjacent to one another and also it is important that the other line of magnets across the gap (50) have an opposite polarity to cause the attractive forces represented by the magnetic flux lines (51).

Referring again to FIG. 7, it is noted that a base plate (52) is preferably constructed of a one-eighth inch plate of steel. This steel plate (52) has magnets (41)-(46) not only adhered thereto by double faced tape (47), but also by the attractive magnetic forces in the magnets (41)-(46) which will hold the magnets against the steel plate (52). It is to be understood that the invention will work without the double faced tape (47).

Steel pole pieces (55) and (56) are positioned over the top of the magnets (41)-(46) as shown in FIG. 7 and they have double faced tape (47) between the magnets and the pole pieces although the double faced tape is strictly optional. On top of the pole pieces (55) and (56) and between the green felt material (36) and the pole pieces (55) and (56) is more double faced tape (47) which permits the green felt (37) to simulate grass and also protect the bottom of the club head (37) from being scratched when it is placed onto the platform (11) or removed therefrom. The double faced tape permits the green felt material (36) to be easily removed and replaced when it wears out. Other metal plates (58) and (59) are utilized having double faced tape (47) therebetween, as shown in FIG. 7, merely to keep the platform (11) of a uniform thickness, although they are certainly not required to make the invention operate.

Figure 8:
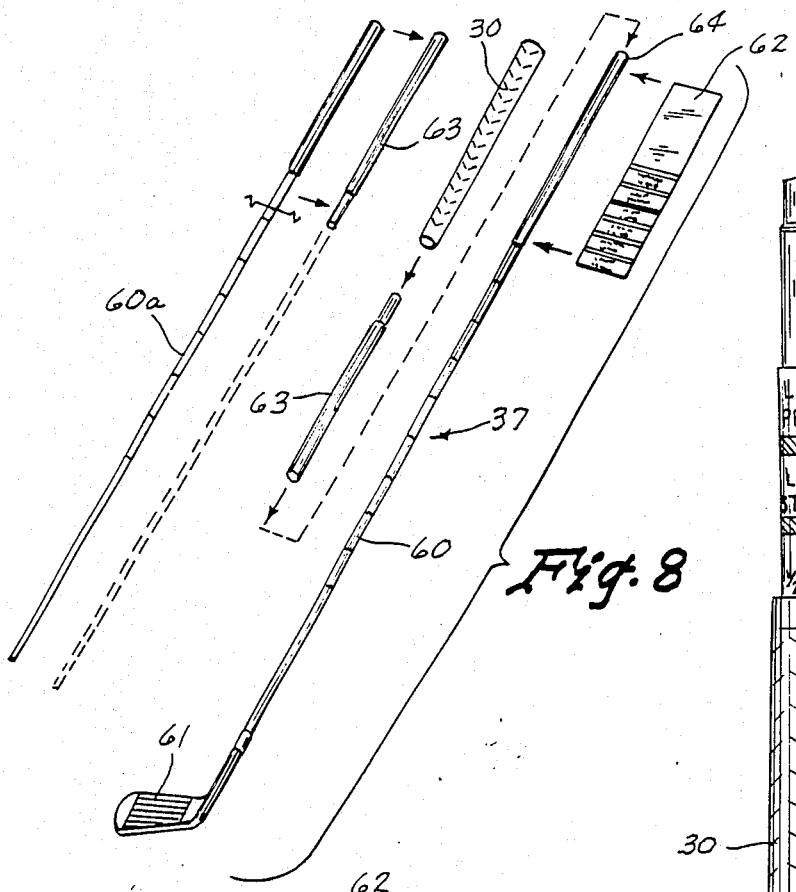
FIG. 8 is an exploded perspective view of a golf club having a telescoping handle thereon for the purpose of fitting a golfer with the proper length of club and helping the golfer choose the desired grip therefore.
Figure 9:
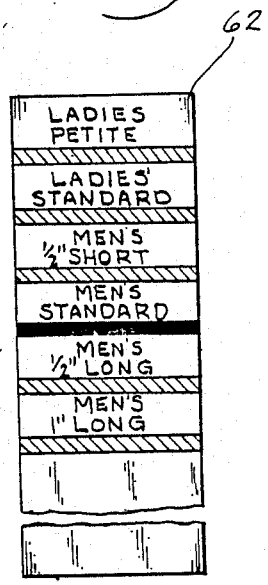
FIG. 9 shows a strip of Mylar material having adhesive on the opposite side of that shown and having various indicia imprinted thereon so that the Mylar strip can be adhered to the club shaft underlying the telescoping handle.

Referring now to FIGS. 8–9, it is noted that the golf club (37) has a steel shaft (60) having a steel club head (61) attached at the bottom thereof and a mylar strip (62) glued to the top thereof. This mylar strip (62) has certain indicia thereon as is clearly shown in FIGS. 9 and 10. A grip or handle (30) has a metal tube (63) fastened therein and this tube (63) is slightly larger in an interior diameter than the exterior diameter of portion (64), which has the mylar (62) thereon. Consequently, the handle (30) and tube (63) can slide over the top of the portion (64) of the handle (60) in a fairly close tolerance relationship, but not so tight so as to damage the mylar strip (62).

Figure 10:
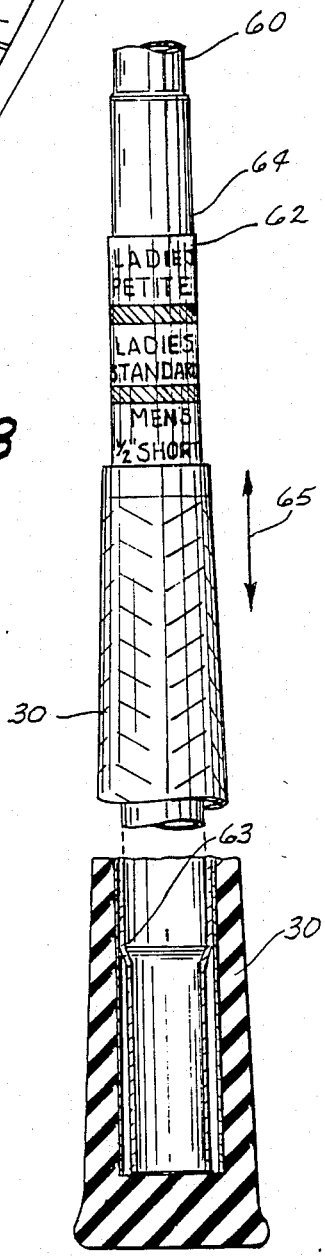
FIG. 10 is an exploded and partially cross sectional view of the handle and shaft of the golf club shown in FIG. 8 and showing how the handle is telescopically disposed on the shaft and how the shaft has indicia thereon for quickly informing the golfer about which length of handle is appropriate after the handle is telescoped to simulate the proper length of the club for the particular golfer.

Referring to FIG. 10 it is noted that the handle can slide over the top of the mylar strip (62) in the direction of the arrow (65) so that the length of the club (37) can effectively be changed for simulation purposes for fitting a golfer to find the proper length of club to be used. The tube (63) is typically formed by cutting a section off of a golf club (60*a*) which is slightly larger in size than the shaft (60) shown in FIG. 8.

Figure 11:
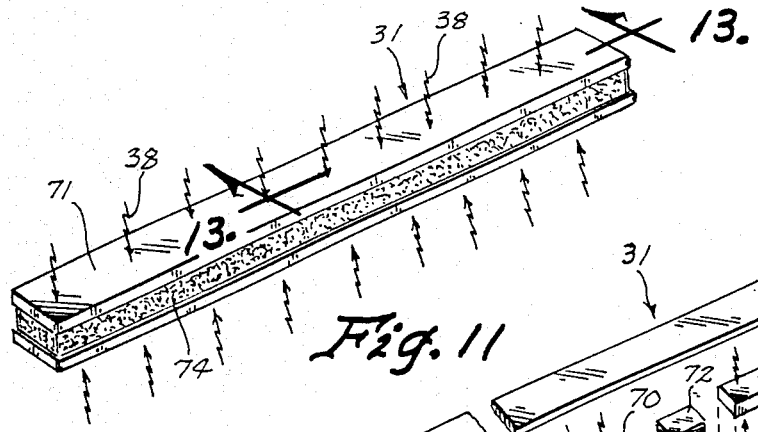
FIG. 11 is a perspective view of a magnetic apparatus and having magnetic lines drawn to indicate that the magnetic handles of golf clubs will be attracted thereto and held thereto.
Figure 12:
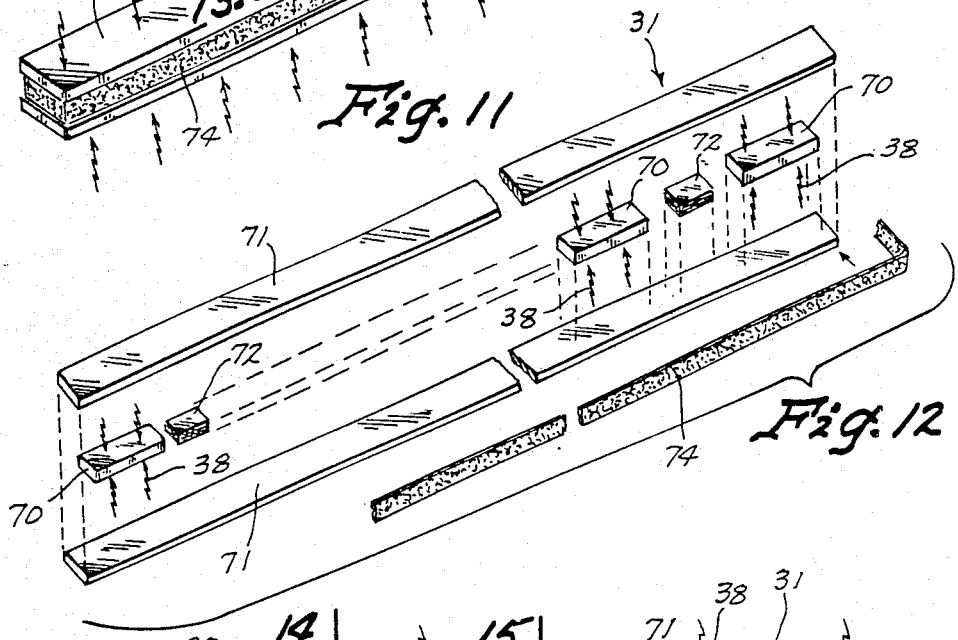
FIG. 12 is a partial exploded view of the apparatus of FIG. 11 showing how spaced apart magnets and wooden spacers are sandwiched between two steel bars for holding such bars together and inducing magnetic forces through them.
Figure 13:
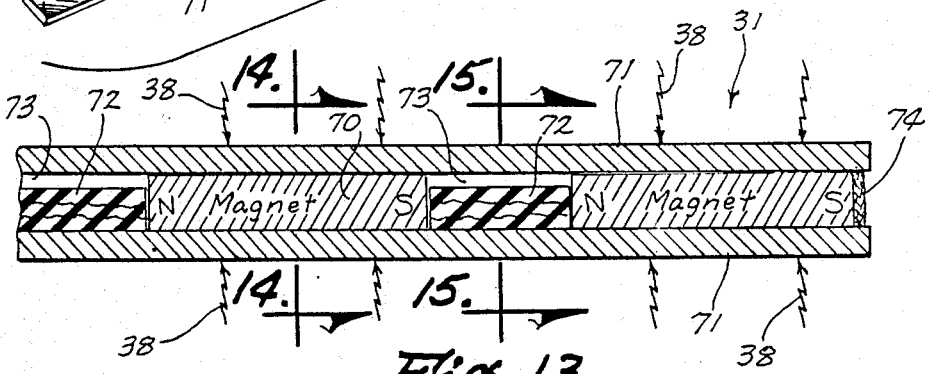
FIG. 13 is an enlarged, partial, cross sectional view along line 13—13 of FIG. 11.
Figure 14:
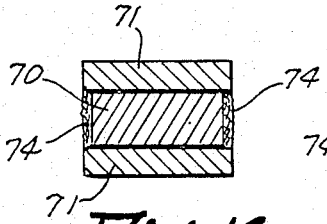
FIG. 14 is a cross sectional view taken along line. 14—14 of FIG. 13.
Figure 15:
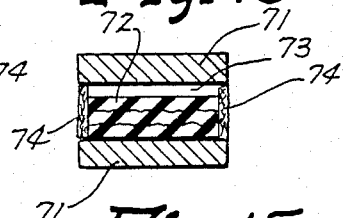
FIG. 15 is a cross sectional view taken along line 15—15 of FIG. 13.
Figure 21:
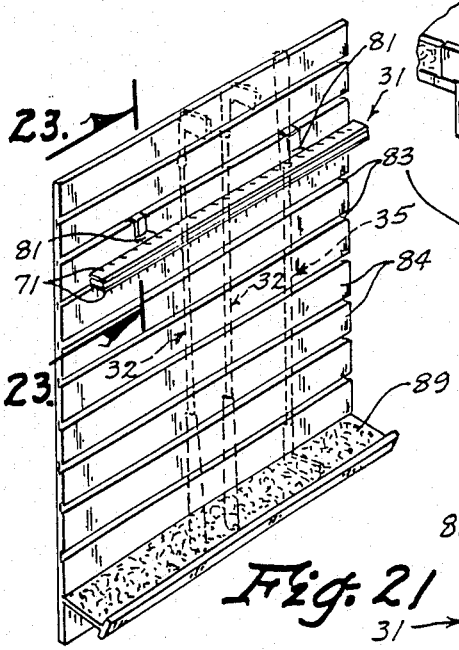
FIG. 21 is a perspective view of a slat wall having slots or grooves therein for attaching golf club holding devices of FIGS. 11 and 12 therein.
Figure 22:
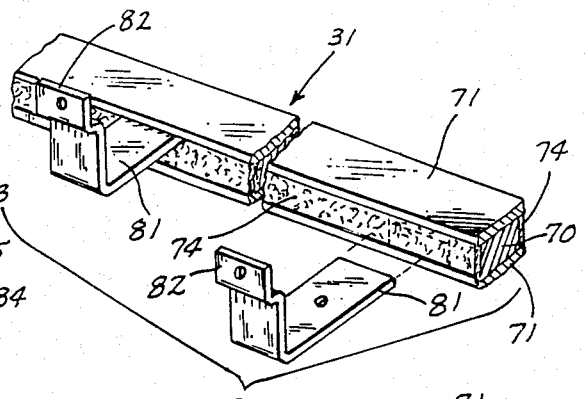
FIG. 22 is a perspective view of the magnetic devices of FIG. 11 having brackets attached thereto for insertion in the slat wall of FIG. 21.
Figure 23:
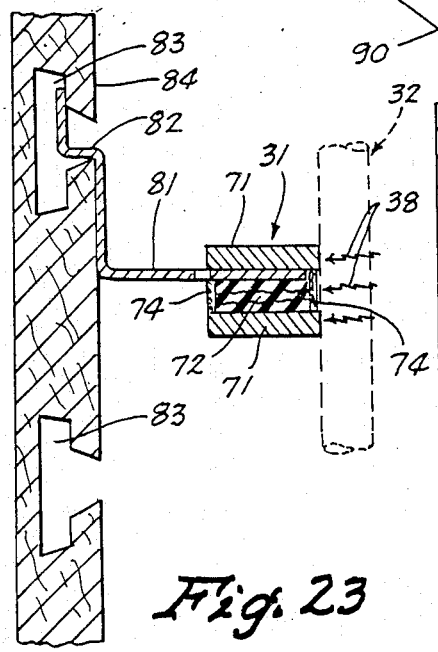
FIG. 23 is a cross sectional view taken along line 23—23 of FIG. 21 showing how metal brackets are magnetically attached to the magnetic devices of FIG. 11 and which also are held by gravity into the slots of the slat wall of FIG. 21.

Referring now to FIG. 11, it is noted that a magnetic golf club holding apparatus (31) is shown and lines of flux (38) are shown which are induced from a plurality of spaced apart ceramic magnets (70) which hold steel chrome plated bars (71) together and which have wooden spacers (72) glued to the bottom steel bar (71), thereby forming a space (73) between the wooden spacers (72) and the top bar (71) as is shown in FIGS. 13 and 15. Green felt material (74) is glued to the edges of the bar magnets (70) and the wooden spacers (72) around the front and sides thereof for aesthetic purposes. The magnetic devices (31) shown in FIG. 11 can be utilized by magnetically attaching them to the steel upright members (12) in FIGS. 1, 4 and 16–19, or they can be utilized by inserting a chrome plated steel bracket (81) into the slot (73) above spacer (72) so that the magnetic forces induced into the top bar (71) will hold the bracket (81) securely to the bar (71). Then the top end (82) of the bracket (81) can fit into slots or grooves (83) in slot walls (84) as shown in FIGS. 21 and 23.

Alternatively, the bracket (81) can be turned around so that the portion (82) extends into the slot (73) above wooden spacer (72) so that portion (82) of bracket (81) magnetically attaches to the top bar (71) and so a screw (85) can extend through opening (86) in portion (87) of bracket (81) to hold the bracket (81) securely to a wall or other upright member (88). (FIG. 25)

Figure 24:
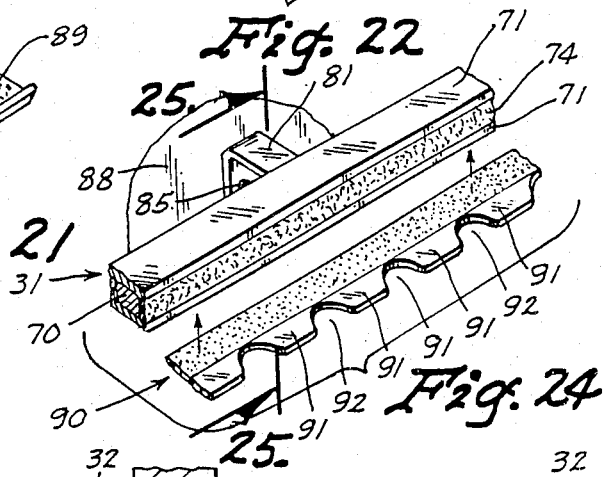
FIG. 24 is a perspective of a magnetic bar arrangement such as that shown in FIGS. 11 and 12 but having a plexiglass member glued to the bottom thereof so as to have projections extending therefrom creating depressions for receiving the shafts of golf clubs therein for maintaining such golf clubs in a predetermined, spaced-apart and aligned relationship.
Figure 25:
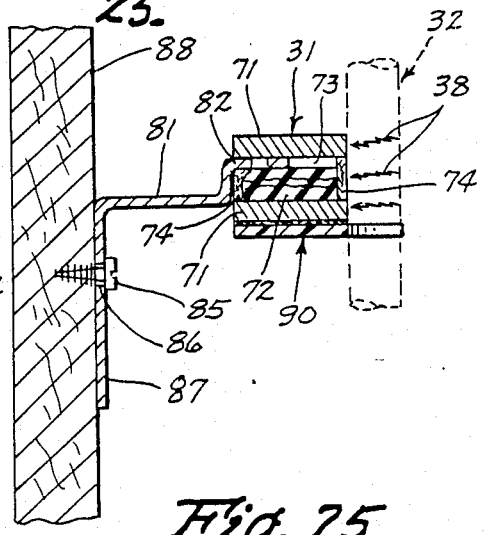
FIG. 25 is a cross sectional view taken along line 25—25 of FIG. 24.

Optionally, a plexiglass member (90) can be glued to the bottom of the bottom steel bar (71) as is shown in FIGS. 24 and 25. The plexiglass member (90) has a plurality of projections (91) extending therefrom which causes a plurality of depressions (92) spaced between the projections (91). The projections (91) extend outwardly from the lower bar (71), as shown in FIG. 25, so that when a golf club shaft (32) is placed against the magnetic device (31) as shown in FIG. 25 it will be held in one of the slots (92) and be prevented from shifting from side to side.

Referring now to FIGS. 16–20, it is noted that an alternate form (100) of the invention is shown which is basically the same as the custom fitting station (10) of FIG. 1 except that it does not have certain braces and does not have a place for a television and video recorder thereon. Otherwise, the platform (111) is the same as the platform (11) as shown in FIG. 1 except that only four magnets (41), (42), (45) and (46) are used, instead of six. Otherwise, the relationship is identical. Upright frame members (112) are bolted to the platform (111) by bolts (113) and plexiglass sheets (118) provide a place for display materials. Magnetic assemblies (31), which are shown in detail in FIGS. 11–15, are magnetically attached to the upright steel posts (112) and have golf clubs (37) magnetically attached thereto just like in the FIG. 1 embodiment. Similarly, the golf club (37) having the head thereof resting on the platform (111) operates identically to the structure shown in FIGS. 6 and 7 although, as mentioned, it uses only four magnets, instead of six.

The operation of the custom fitting station (10) as shown in FIG. 1 can be set up in a Pro Shop, for example, just the way it is seen in FIG. 1 except that probably more clubs would be attached to the magnetic assembly (31) and also more golf clubs would be attached to each side of the golf club (37) wherein a number of golf clubs (37) would be in an addressed position wherein the club portion as shown in FIG. 26 would cross the gap (50) and be held in such address position. At the same time, a VCR (37) would be running a promotional tape which would catch the customer's eye immediately upon seeing the apparatus (10).

As the customer was drawn to the promotional tape being shown on the television (26), the clubs (37), being in a natural address position and somehow magically held in that position create a very inviting marketing situation wherein the customer is invited to grasp the club (37) as though the customer was in an actual golfing situation. After having grasped the club (37), the customer is able to overcome the magnetic flux forces (51) as shown in FIG. 26 and pick up the club (37) and inspect it carefully. At that point in time, a golf pro could begin to talk to the customer and explain the various important features of golfs club and explain to the customer how such clubs must be properly fitted to a user. In this process, the golf pro can explain the importance of the lie angle "A" as shown in FIG. 26 and explain how and why shorter people need a greater lie angle "A" and how taller people need a smaller lie angle "A". A club with a proper lie angle for this particular customer can then be examined.

The customer could then choose one of any number of grips (30) which would be placed in the holes (29) in plate (21) and once a preliminary selection is made, the handle or grip (30) could replace the one on the club being fitted. During this process, the handle or grip (30) can slide in the direction of the arrow (65), as shown in FIG. 10, and the golf pro and the customer can jointly decide what the proper length of club should be among various standard lengths. This can all be done while the club head is in the position shown in FIG. 26 in a proper address position.

If the customer wishes to see other types of golf clubs other than golf clubs (37), golf clubs (32) attached to magnetic devices (31) on the sides of the custom fitting station (10) can be shown.

Figure 16:
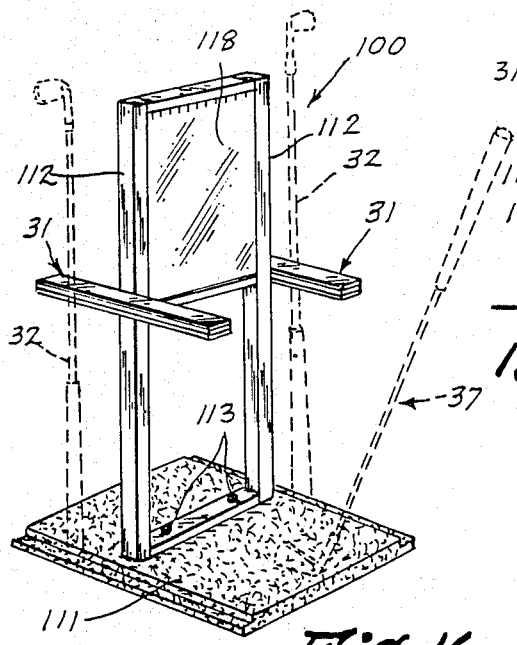
FIG. 16 is a perspective view of an alternate form of the invention from that shown in FIG. 1 but including the two major magnetic club holding features.
Figure 17:
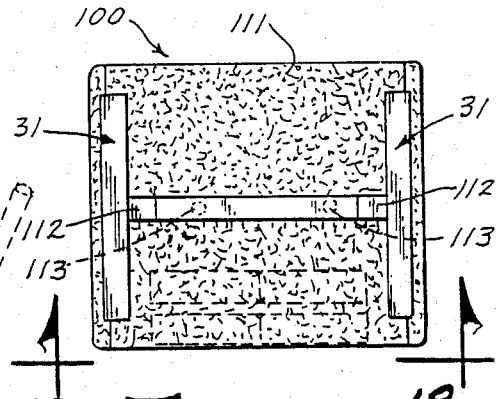
FIG. 17 is a top plan view of the platform or base of the apparatus shown in FIG. 16.
Figure 18:
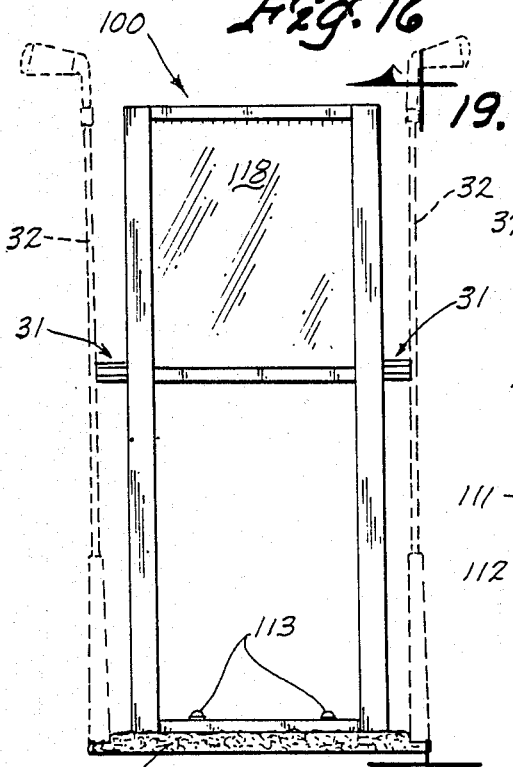
FIG. 18 is a front view taken along line 18—18 of FIG. 17 and showing golf clubs in dashed lines being held by the magnetic devices thereof.
Figure 19:
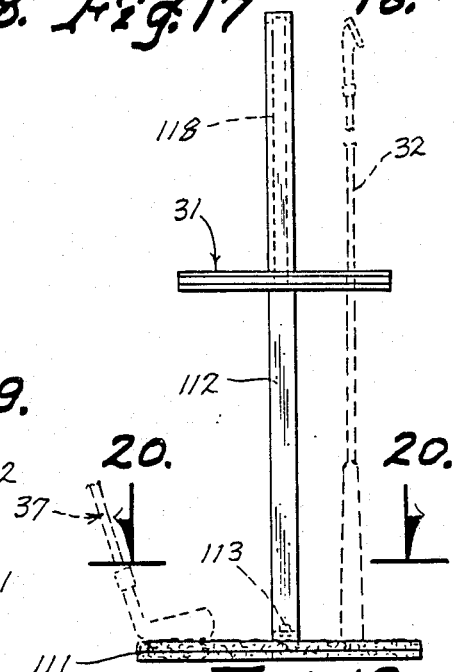
FIG. 19 is a slide elevational view taken along line 19—19 of FIG. 18.
Figure 20:
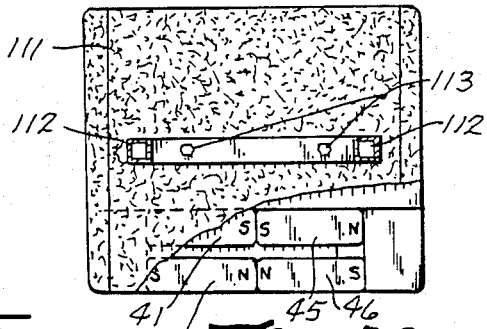
FIG. 20 is a cross sectional view taken along line 20—20 of FIG. 19 and also showing a portion of the platform broken away to show the orientation of the bar magnets disposed therein.

Referring to FIGS. 16–20, it is noted that it is not absolutely necessary to have the VCR and television portion of the apparatus (10) included and the structure in common between the apparatus (100) in FIG. 16 and that shown in apparatus (10) of FIG. 1 will still function as a powerful sales and marketing tool.

Referring now to FIG. 21, it is noted that golf clubs (32) can easily be displayed on a slat wall (84) by attaching the magnetic shafts to the magnetic device (31) and resting the handles of the club on a shelf (89). Similarly, other devices can be displayed on the magnetic device (31) such as shoes having a metal plate held thereto by first loosening the cleats of a golf shoes and then tightening them over a steel plate. Then the steel plate can be placed against the magnetic structure (31) to hold the shoes in place. Also, other brackets which are metal can be used to hold items such as small golf bags which can also be magnetically held for display purposes on magnetic structure (31).

Figure 4:
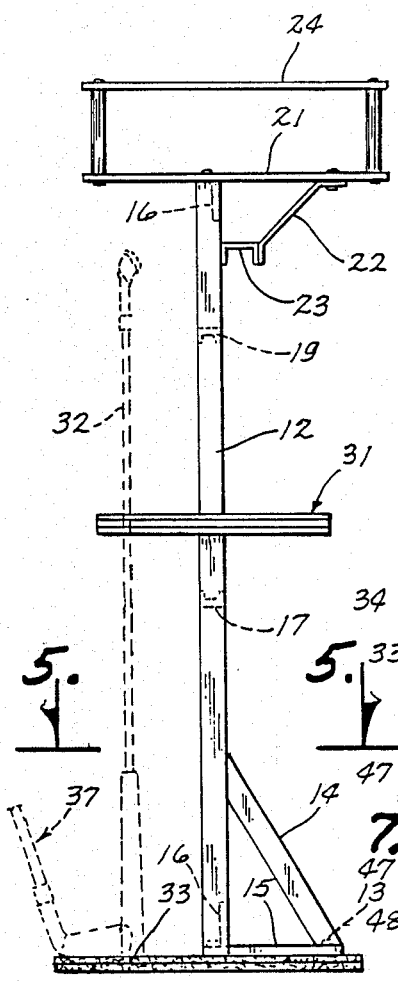
FIG. 4 is a side elevational view taken along line 4—4 of FIG. 3 and showing golf clubs in dashed lines.
Figure 5:
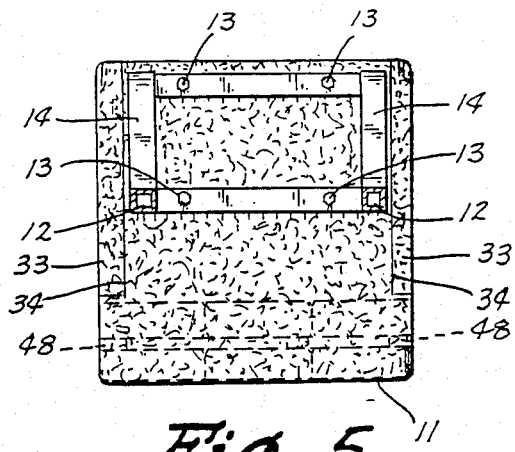
FIG. 5 is a cross sectional view taken along line 5—5 of FIG. 4.

The plexiglass member (90) shown in FIG. 24 can be utilized on a regular wall (88), on a slat wall (84) or on the magnetic devices (31) in the situations shown in FIGS. 1, 4, or 16 for example.

Accordingly, it will be appreciated that the preferred embodiments shown herein do indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. A magnetic golf club holding apparatus comprising:

a first elongated bar constructed of a material attracted by magnetic forces;

a second elongated bar constructed of a material attracted by magnetic forces;

magnetic means disposed between said first and second elongated bars for holding said first and second bars together and including magnetic forces into said first and second elongated bars;

means for holding said first and second elongated bars above the floor; and a golf club having a head with a metal shaft attached thereto, said metal shaft being held in an upright position substantially against said first and second elongated bars by magnetic forces from said magnetic means and said shaft being constructed of a material which is attracted by magnetic forces.

2. The apparatus of claim 1 including a stand having a platform adapted to rest on a floor and one upright member attached to said platform, said upright member being constructed of a material attracted to magnetic forces and said first and second elongated bars being attached to said upright member by said magnetic means.

3. The apparatus of claim 1 wherein said platform includes a depression including a substantially vertical wall, a handle attached to said golf club shaft being disposed in said depression and in abutment with said vertical wall for frictionally holding said golf club from pivoting about the longitudinal axis of said golf club for display purposes.

4. The apparatus of claim 1 including a bracket constructed of a material attracted to magnetic forces, said bracket extending into a space between said first and second elongated bars and being magnetically attached at one end thereof to one of said first and second elongated bars and adapted to be attached at the other end thereof to a vertical wall.

5. The apparatus of claim 4 wherein said vertical wall is a slat wall having slots therein and said other end of said bracket extending into one of the slots in the slat wall for holding said bracket from dropping to the floor.

6. The apparatus of claim 5 including a second bracket attached at one end thereof to another portion of said first and second elongated bars and at the other end thereof to another slot in another portion of said slat wall.

7. The apparatus of claim 1 including an elongated member attached to one of said first and second elongated bars, said elongated member having a plurality of spaced apart projections extending from one edge thereof beyond an edge of said first and second elongated bars for providing depressions into which golf club shafts can rest for the purpose of easily spacing apart golf clubs to be displayed on said apparatus.

8. The apparatus of claim 1 wherein said golf club has the head portion thereof up and has a handle portion on the downward end thereof and means in contact with said handle portion for frictionally preventing said shaft from rotating once it is positioned in a desired position.

* * * * *